US007614763B2

(12) United States Patent
Leibinger et al.

(10) Patent No.: US 7,614,763 B2
(45) Date of Patent: Nov. 10, 2009

(54) OPERATING TABLE LAMP

(75) Inventors: Berthold Leibinger, Gerlingen (DE); Christian Bartenbach, Aldrans (AT); Rudolf Marka, Munich (DE); Kamran Tahbazian, Munich (DE); Markus Vogl, Munich (DE); Willibald Hiemer, Munich (DE)

(73) Assignee: Trumpf Medizin Systeme GmbH + Co. KG, Puchheim (DE)

( * ) Notice: Subject to any disclaimer, the term of this patent is extended or adjusted under 35 U.S.C. 154(b) by 0 days.

(21) Appl. No.: 11/067,580

(22) Filed: Feb. 28, 2005

(65) Prior Publication Data

US 2005/0231945 A1 Oct. 20, 2005

(30) Foreign Application Priority Data

Feb. 28, 2004 (EP) ..... 04004602
Aug. 6, 2004 (EP) ..... 04018642

(51) Int. Cl.
*F21V 9/08* (2006.01)

(52) U.S. Cl. ..... 362/235; 362/231; 362/293; 362/552; 362/572

(58) Field of Classification Search ..... 362/231, 362/235, 552, 572, 293, 804, 351, 295, 394, 362/251, 181
See application file for complete search history.

(56) References Cited

U.S. PATENT DOCUMENTS 3,588,488 A * 6/1971 Lauterbach ..... 362/2
3,930,149 A * 12/1975 French ..... 362/285
4,196,460 A * 4/1980 Schreckendgust ..... 362/231
4,380,794 A * 4/1983 Lawson ..... 362/296
4,757,426 A * 7/1988 Scheller et al. ..... 362/20
6,488,390 B1 * 12/2002 Lebens et al. ..... 362/231
6,495,964 B1 12/2002 Muthu et al. ..... 315/149
6,636,003 B2 10/2003 Rahm et al.
6,788,011 B2 9/2004 Mueller et al.
6,880,957 B2 * 4/2005 Walters ..... 362/276
7,014,336 B1 3/2006 Ducharme et al.
7,145,125 B2 * 12/2006 May et al. ..... 362/235
2001/0021108 A1 9/2001 Shimada et al. ..... 362/103
2002/0048177 A1 4/2002 Rahm et al. ..... 362/555
2003/0165055 A1 9/2003 Scholz ..... 362/33

(Continued)

FOREIGN PATENT DOCUMENTS

DE 198 38 627 3/2000

(Continued)

OTHER PUBLICATIONS

"Metalldampflampe", from Wikipedia, Jan. 7, 2007, 2 pages, http://de.wikipedia.org/wiki/Metalldampflampe—English equivalent is "Gas-discharge Lamp", also from Wikipedia, http://en.wikipedia.org/wiki/Gas-discharge_lamp.

(Continued)

*Primary Examiner*—Bao Q Truong
(74) *Attorney, Agent, or Firm*—Fish & Richardson P.C.

(57) ABSTRACT

An operating lamp includes at least one white light source for illuminating an operating area, a plurality of colored light sources for illuminating the operating area, and a controller adapted for dimming a light intensity and controlling a spectrum of a combined illumination from the white light source and the colored light sources on the operating area.

20 Claims, 3 Drawing Sheets

U.S. PATENT DOCUMENTS

| | | | | |
|---|---|---|---|---|
| 2003/0185009 | A1 | 10/2003 | Walters | 362/276 |
| 2004/0129860 | A1 | 7/2004 | Thibaud et al. | |
| 2005/0195599 | A1 | 9/2005 | Marka | |

FOREIGN PATENT DOCUMENTS

| | | |
|---|---|---|
| DE | 100 34 594 | 1/2002 |
| DE | 10216645 | 11/2003 |
| EP | 1462711 | 9/2004 |
| EP | 1568936 | 8/2005 |
| WO | WO9922224 | 5/1999 |
| WO | WO 00/35402 | 6/2000 |
| WO | WO 01/36864 | 5/2001 |
| WO | 03/019072 | 3/2003 |
| WO | WO 03/096761 | 11/2003 |

OTHER PUBLICATIONS

Hit-Colorlite: Metal-halide lamps in green, blue, magenta and orange, BLV Produktkatalog, 2004/2005, 1 page.

Halogen Gluehlampen, BLV-USHIO Group, 2006, 11 pages.

Notice of Opposition of Brandon Medical Ltd. as filed in the European Patent Office, filed Jun. 21, 2007, 23 pages.

Notice of Opposition of Berchtold Holding GmbH, including English translation, dated Jun. 26, 2007, 30 pages.

Notice of Opposition of Dr. Mach GmbH & Co. KG, including English translation, dated Jun. 27, 2007, 52 pages.

Reply of Patent Proprietor to Notice of Opposition, dated Mar. 20, 2008, 46 pages.

English translation of Office Action from corresponding Chinese Application No. 200610171942.1 dated Mar. 10, 2009, 3 pages.

Annex to Search Report of European Patent Application No. 04 004 602.1, in German language with English translation, mailed Jun. 30, 2004, 7 pages.

U.S. Appl. No. 11/559,584, Rudolf Marka et al., "Lamp Power Tabulation", specification, claims and drawings, 14 pages.

* cited by examiner

OPERATING TABLE LAMP

CLAIM OF PRIORITY

This application claims priority under 35 USC § 119(a) to European Patent applications, number 04004602, filed on Feb. 28, 2004, and number 04018642, filed Aug. 6, 2004, the entire contents of which are hereby incorporated by reference.

TECHNICAL FIELD

The disclosure relates to an operating table lamp.

BACKGROUND

An operating lamp or a medical lamp can be dimmed to prevent the operating surgeon from being blinded due to reflection of the light by different materials. For example, light skin and white fatty tissue produce high reflection, while red tissue absorbs a relatively higher percentage of light and therefore appears darker. Dimming of the incident light from the operating lamp can also compensate for eyestrain of the operating surgeon. For example, an operation can begin with dimmed light, and the light intensity can be increased during the course of the operation to compensate for the surgeon's tiring eyes that become increasingly less sensitive.

The operating surgeon requires a lamp having light-technological properties that are independent of the brightness of the light and that are as constant as possible to ensure natural vision and optimum assessment of the illuminated objects.

Halogen lamps, gas discharge lamps, and light emitting diodes ("LEDs") can be used as illumination sources for a medical lamp. All these illumination sources, however, have the property that the color temperature of the light considerably changes through electric and/or electronic dimming of the illumination source.

The human eye is accustomed to daylight, and human vision is adjusted to daylight, and the operating surgeon benefits from intense light that is similar to daylight. The human eye optimally recognizes contours and is able to distinguish colors and recognize movements at daylight.

For this reason, it is desirable to generate illumination conditions in an operating room that are comparable to those of daylight. Also, the area of operation does not reflect all light directed toward it but absorbs a portion of the light, and the absorption can be wavelength-dependent.

The sensory impression of color is determined by the spectral distribution of light perceived by a person, and the spectral distribution can be associated with a "color temperature" because a blackbody radiation source produces light having a spectral distribution that depends on the temperature of the radiation source. For example, daylight has a color temperature of 5,600 Kelvin. It is known from literature that, in accordance with the Kruithoff comfort curve, the color temperature of a light source should be matched with the illuminance to provide comfortable illumination conditions for humans. White light having a color temperature of approximately 4,500 Kelvin with high illuminance (>100,000 Lux) is recommended as light in operating rooms.

The ideal color temperature can be obtained by filtering light from a light source through color conversion filters. Instead of using color conversion filters, it is also possible to add colored light to white light from a source to correct the color temperature of the source.

SUMMARY

In a general aspect, an operating lamp includes at least one white light source for illuminating an operating area, a plurality of colored light sources for illuminating the operating area, and a controller adapted for dimming a light intensity and controlling a spectrum of a combined illumination from the white light source and the colored light sources on the operating area.

Implementations can include on or more of the following features. For example, the controller can be adapted for maintaining a color temperature of the light on the operating area while changing the intensity of the light on the operating area. The controller can be adapted for maintaining a color reproduction of the light on the operating area while changing the intensity of the light on the operating area. The controller can be adapted for maintaining a constant light intensity on the operating area while changing the spectrum of the light on the operating area.

The white light source can be an LED, a halogen lamp, or a gas discharge lamp. The colored light sources can be LEDs, halogen lamps and color filters, or gas discharge lamps and color filters.

The operating lamp can further include a variable shade adapted for obscuring a varying amount of light from the white and colored light sources from the operating area, and the controller can be adapted for controlling the amount of light obscured by the variable shade. The variable shade can include a mechanical shade or an optical shade. The controller can be adapted for controlling an amount of electrical power that powers the light sources. The operating lamp can further include lenses between the light sources and the operating area, and the lenses can be adapted to provide uniform emission of light from the lamp and focus the light onto the operating area.

In another general aspect, an operating lamp can include a means for illuminating an operating area with white light, a means for illuminating the operating area with colored light, a dimming means for dimming a light intensity from the illumination means at the operating area, and a control means for controlling a spectrum of light from the illumination means at the operating area.

Implementations can include one or more of the following features. For example, the dimming means and the control means can be adapted for maintaining a color temperature of the light on the operating area while dimming the intensity of the light. The dimming means and the control means can be adapted for maintaining a color reproduction of the light on the operating area while dimming the intensity of the light. The dimming means and the control means can be adapted for maintaining an intensity of the light on the operating area while changing the spectrum of the light on the operating area. The dimming means can include a variable shade adapted for obscuring a varying amount of light from the illumination means from the operating area. The dimming means can be adapted for controlling an amount of electrical power that powers the illumination means. The operating lamp can further include lenses between the illumination means and the operating area, where the lenses are adapted to provide uniform emission of light from the lamp and focus the light onto the operating area.

In further general aspect, a method of controlling an operating lamp for illuminating an operating area includes proving light from a white light source of the lamp to the operating area, providing light from a plurality of colored light sources of the lamp to the operating area, controlling an intensity of light at the operating area provided from the white light source and the colored light sources, and controlling a spectrum of the light at the operating area provided from a combination of the white light source and the colored light sources.

Implementations can include one or more of the following features. For example, the method can further include maintaining the intensity of the light at the operating area while changing a color temperature of the light. The maintaining a color temperature of the light at the operating area while changing the intensity of the light. The maintaining a color reproduction of the light at the operating area while changing the intensity of the light. Controlling the intensity of light at the operating area can include controlling an amount of electrical power that powers the light sources. The method can further include focusing light from each of the light sources with a lens, where the lenses are adapted to provide uniform emission of light from the lamp and focus the light onto the operating area.

The details of one or more implementations are set forth in the accompanying drawings and the description below. Other features will be apparent from the description and drawings, and from the claims.

DESCRIPTION OF DRAWINGS

Like reference symbols in the various drawings indicate like elements.

DETAILED DESCRIPTION

To improve the technical aspects of lighting for operations, to eliminate the disadvantages associated with color temperature changes and color reproduction changes due to dimming of an operating lamp, and to allow adjustment of the color temperature and color reproduction while maintaining a constant brightness, an operating lamp is disclosed that generates a mixed light with adjustable light-technological data by adding colored light (e.g., generated by colored LEDs) to a light from a white light source. The electric parameters for dimming can thereby be stored in the control electronics (e.g., in a characteristic diagram or characteristic line) such that in case of continuous change of the brightness, the preselected color temperature and color reproduction are kept constant.

A controller connected to corresponding sensors can adjust, monitor, and readjust a desired color temperature and/or color reproduction and keep these parameters constant at a defined brightness. The controller provides, in particular, that the operating surgeon can generate illumination conditions in the area of an operation that match his or her individual requirements. Depending on the color temperature or color reproduction, various tissue structures or tissue features within the area of an operation can be emphasized.

Dimming of the light can be achieved through mechanical and/or optical means. For example, dimming of the light can be generated through change of the electric current and/or electrical power that is supplied to the LED. Alternatively, shutters, lenses, or optical filters that can be mechanically or electrically activated and that can be moved into the optical path of the light, can change the light flux, while the color temperature or color reproduction remains constant during mechanical dimming.

Figure 1:
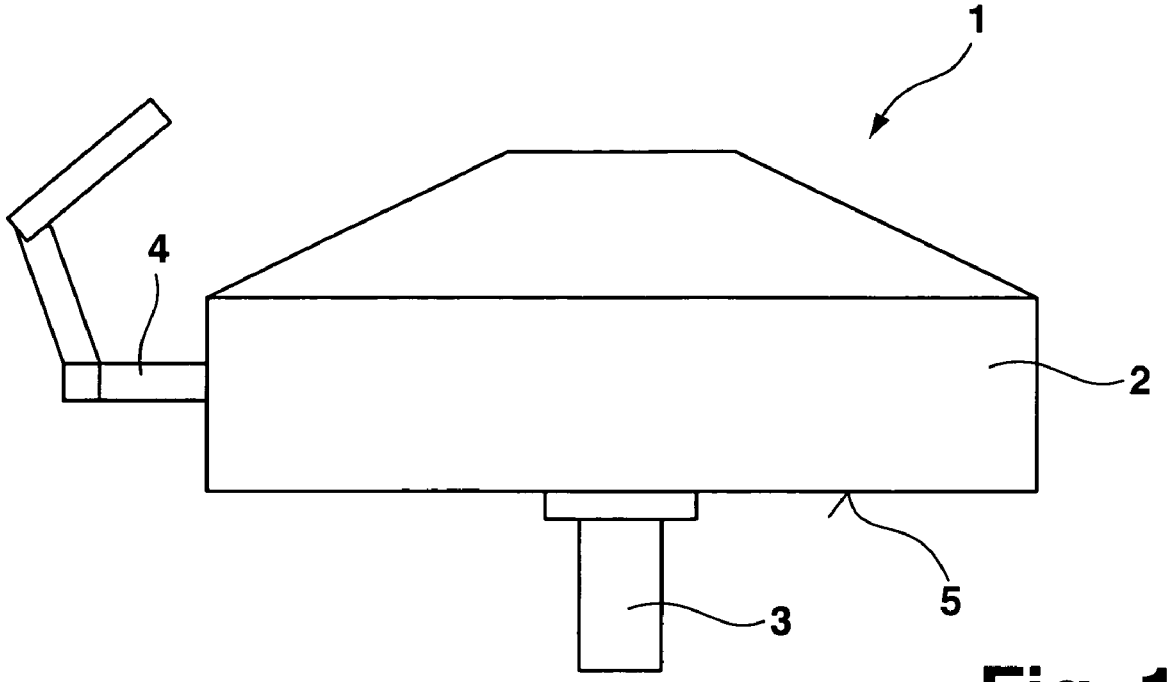
FIG. 1 shows an operating lamp.

As shown in FIG. 1, an operating lamp 1 includes a lamp body 2 having an inner space that houses an illumination means (not shown in FIG. 1). The lamp body 2 can be mounted on a stationary holder on a ceiling or wall of a building or mobile unit, such that it can be pivoted via a pivot arm (which is not completely shown in FIG. 1). The pivot arm is formed from several elements that are interconnected by joints. An element 4 of the pivot arm that is rigidly connected to the operating lamp 1 is indicated in FIG. 1. The operating lamp 1 can therefore be moved and pivoted in three dimensions in the X, Y, and Z directions. A handle 3 mounted to the lamp body 2 permits positioning of the operating lamp 1 at any location above an operating table. The handle 3 is detachably disposed on the lower side 5 of the operating lamp. Light is emitted on the lower side 5 of the operating lamp 1 to illuminate the location to be operated on.

Figure 2:
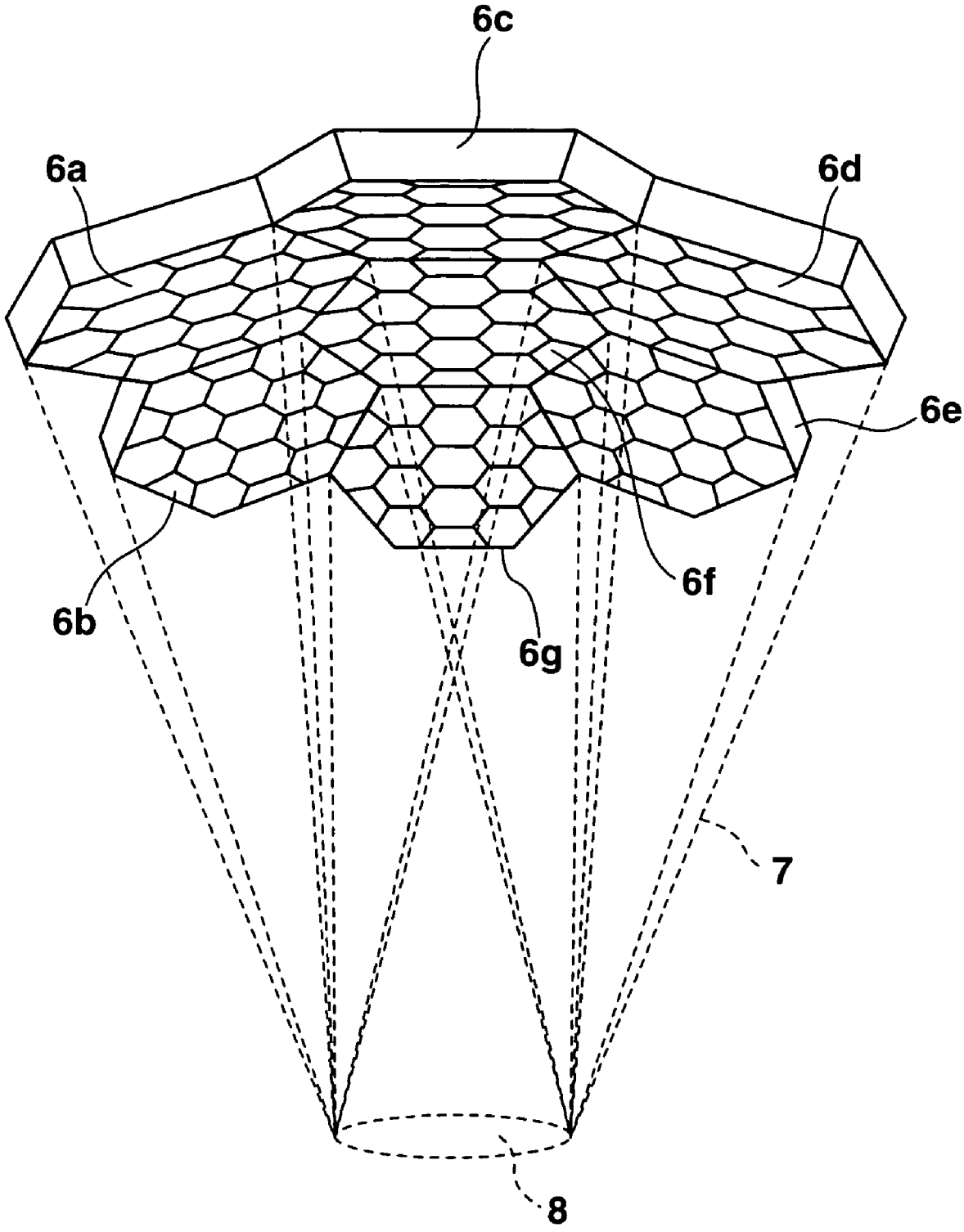
FIG. 2 shows several light modules of the operating lamp in accordance with FIG. 1.

As shown in FIG. 2, individual light modules 6*a-g* are joined together almost seamlessly to form the light source, and the spacing or the transitions between the individual light modules 6*a-g* have no substantial influence on the optical properties of the composite light source formed from all modules 6*a-g*, in particular, on the light emitted in the direction of the operating area. The light generated by the combination of modules 6*a-g* is perceived as being generated from a uniform source despite the fact that the light source is composed of several light modules 6*a-g*.

Each light module 6*a-g* includes a plurality of individual LEDs (e.g., 10-50 LEDs). Such LED-based modules provide advantages in light technology analogous to advantages provided by large mirror lamps, such as, for example, reducing shadow by providing a large surface from which light is emitted. Each light module 6*a-g* can completely illuminate an operating area on its own. The light produced by the light modules 6*a-g* is indicated through broken lines by light beams 7, generating a field of illumination 8. The field of illumination 8 can be the surface on the operating table that is illuminated. The light from different light modules 6*a-g* can be combined to form the most different light source, which can change the size, shape, and intensity of the illumination field 8.

Figure 3:
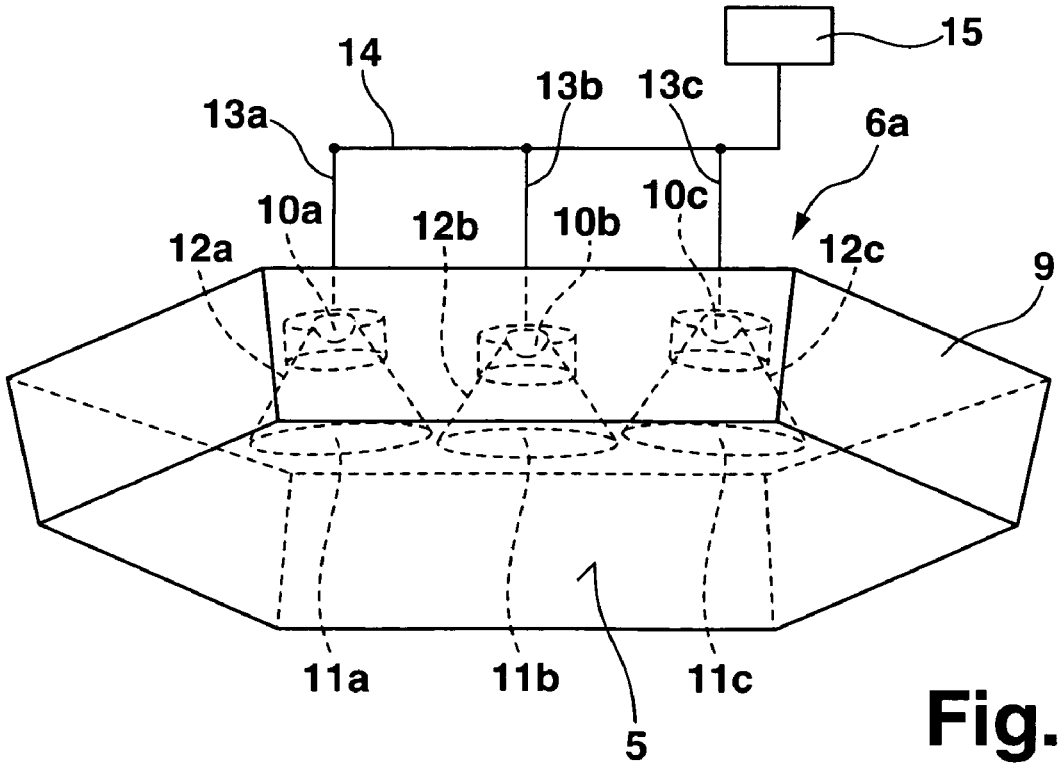
FIG. 3 shows the structure of a light module of FIG. 2 in more detail.

As shown in FIG. 3, an individual light module 6*a* includes a housing 9 having mechanical and/or electric or electronic connecting elements or connectors to connect the light module 6*a* with a neighboring light module 6*b-g*. The light modules 6*a-g* are shaped such that they can be disposed on a spherical surface of a typical radius of 1,000 mm without forming gaps. Towards this end, the light modules 6*a-g* can have a hexagonal shape. When the modules 6*a-g* are joined, they produce a type of honeycomb structure or faceted structure. The surface of the light modules 6*a-g* facing the operating location need not be necessarily flat but may be slightly concave to facilitate reproduction of the curvature of the spherical surface. The optical axis of each light module 6*a-g* generally faces the focus of the spherical surface.

Different shapes of the illumination field 8 can be generated by combining light from modules 6*a-g* oriented at different setting angles. Towards this end, also intermediate elements may be used. Multiple (e.g., 2-100) LEDs can be evenly distributed in each light module 6*a-g*, and three LEDs 10*a-c* are shown in FIG. 3. Although light sources 10*a-c* are shown as LEDs in FIG. 3, other light sources can be used instead of LEDs (e.g., halogen lamps, gas discharge lamps, incandescent lamps, and liquid crystals). Formation of shadows is optimized through planar emission of light from the LEDs 10*a-c*. Towards this end, each of the nearly point source LEDs 10*a-c* can be associated with suitable optical elements (e.g., lenses 11*a-c*), such that light beams 12*a-c* are emitted from the LEDs 10*a-c*, respectively. The shape of the optical elements 11*a-c* is designed such that they fill the light module 6*a* preferably to the edges of the module 6*a*. The lens elements 11*a-c* can also have a scattered structure to make the illumination field more homogeneous. The lower side 5 of the light module 6*a* can be covered by a transparent plate.

The individual light modules 6*a-g* together can form a light source with a color temperature of approximately 4,500 K and a color reproduction index Ra>93 to obtain natural representation of the color of the tissue that is to be operated on. For this reason, LEDs 10*b-c* that generate colored light can be used in module 6*a* in addition to LEDs that generate white light 10*a*. The white LEDs 10*a* are designed analogously to the colored LEDs 10*b-c*. A spectrum of light reflected from tissue when an arrangement with only white LEDs 10*a* is used as the light source can be partially compensated by adding colored light LEDs 10*b-c*, such as, for example, cyan and blue LEDs to the module 6*a*. Moreover, it is possible to generate precise color mixtures that improve the visual performance of the operating surgeon. With a constant brightness of the white LEDs 10*a*, the color temperature and color reproduction of the mixed light generated by the overall module consisting of all individual light modules 6*a-g* (i.e., the complete light source) can be variably adjusted by dimming of the intensity of the colored LEDs 10*b-c* in the light modules 6*a-g*. The light flux intensity of the colored LEDs 10*b-c* can be continuously adjusted, and the overall illumination intensity can be kept constant through matched intensity control of all LEDs 10*a-c*.

The LEDs 10*a-c* are connected electrically through current lines 13*a-c* and 14 to a controller 15 that permits electric dimming of the light flux from the LEDs 10*a-c*. Electric dimming of the colored LEDs 10*b-c* causes change of the color temperature and/or the color reproduction.

A basic setting of the color temperature of 4500 K can be preset such that this color temperature is automatically generated when the operating lamp is switched on.

The brightness, color temperature, and color reproduction of the mixed light from the modules 6*a-g* can be variably adjusted through continuous dimming of the intensity of the white and additional colored light sources 10*a-c*, such that either constant brightness with variable color temperature or color reproduction or a desired dimming state with constant color temperature or color reproduction can be obtained.

During dimming of the LEDs 10*a-c*, the white light source 10*a* and colored light sources 10*b-c* can change the color temperature of the emitted light, thereby changing the color temperature and color reproduction of the mixed light.

The brightness, the color temperature, and color reproduction can be detected with a photometer across the entire dimming range of the lamp. Suitable control parameters (e.g., voltage, current strength) of the white and colored light sources permits control of the individual intensities such that a constant brightness, constant color temperature, or constant color reproduction is obtained. These parameters can be stored as characteristic parameters in the controller 15. For different color temperatures or color reproduction indices, different parameter can be recorded and stored in the controller 15. Instead of storing characteristic parameters, the control electronics can be coupled to one or more sensors for measuring the brightness, color temperature, and color reproduction, and the data from the sensors can be used to adjust the brightness, color temperature, and color reproduction of the lamp 1.

Different color temperatures as desired in dependence on the operating lamp 1 can be adjusted by the operating surgeon using an input device (e.g., a control panel or a keyboard) coupled to the controller 15. The required setting parameters can be stored in a storage of the controller 15. The operating surgeon can store further settings that he or she selects and that can be changed at a later time.

Figure 4:
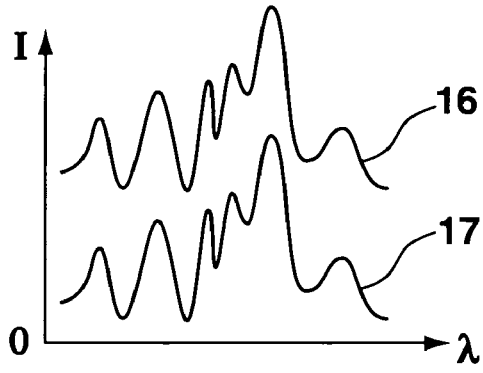
FIG. 4 shows a wavelength spectrum with constant color temperature and color reproduction.

FIG. 4 shows that a spectrum from the lamp (i.e., intensity vs. wavelength, λ) is not changed when the intensity (I) of the light changes. Spectrum 16 characterizes larger brightness, and spectrum 17 characterizes a lower brightness, showing that the color temperature and color reproduction remain unchanged when the intensity changes.

Figure 5A:
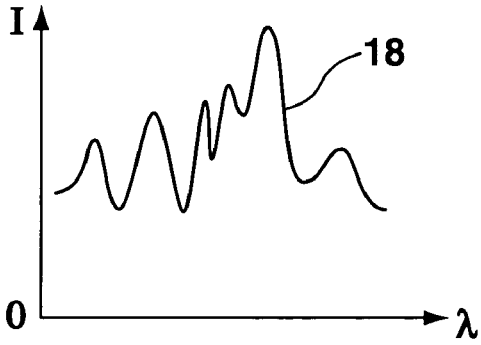
FIGS. 5*a*, 5*b*, 5*c* show wavelength spectra after adjustment of the color temperature and brightness.
Figure 5B:
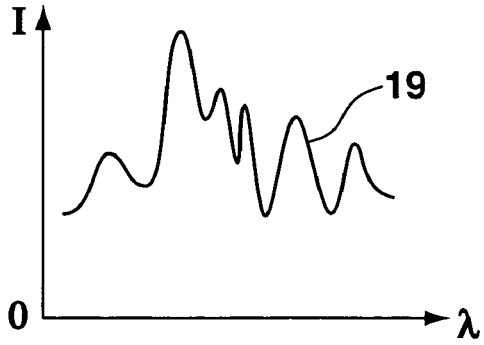
Figure 5C:
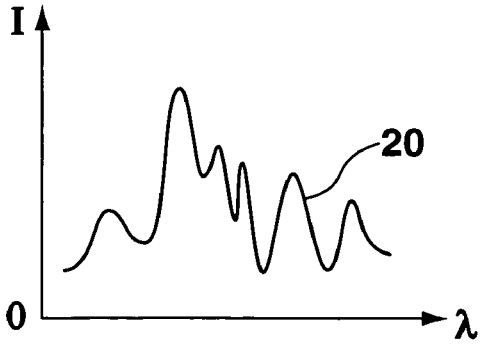

As an alternative, the color temperature can be adjusted with a constant brightness. Towards this end, the spectrum can be changed to change the color temperature while simultaneously maintaining a constant the intensity or brightness of the light. As indicated by the spectrum 18 of FIG. 5*a* and the spectrum 19 in FIG. 5*b*, a color temperature of the lamp can be adjusted by changing the relative intensity at different wavelengths in the spectrum, while keeping the total intensity over all wavelengths constant in the two spectra 18 and 19. Subsequently, the brightness of the lamp can be adjusted while maintaining the spectrum of the light output to yield the spectrum 20 shown in FIG. 5*c*.

A number of implementations have been described. Nevertheless, it will be understood that various modifications may be made. Accordingly, other implementations are within the scope of the following claims.

What is claimed is:

1. An operating lamp comprising:

at least one white light source for illuminating an operating area;

a plurality of colored light sources for illuminating the operating area; and a controller for dimming a light intensity and controlling a spectrum of a combined illumination from the white light source and the colored light sources on the operating area, wherein the controller is configured to enable an operator to control the white and colored light sources in two independent control modes, including a first mode in which the controller changes an overall intensity of light produced by the operating lamp while maintaining an overall color temperature of the produced light, and a second mode in which the controller maintains a constant overall intensity of light produced by the operating lamp while changing an overall color temperature of the produced light.

2. The operating lamp of claim 1, wherein the white light source is a light source selected from the group consisting of an LED, a halogen lamp, and a gas discharge lamp.

3. The operating lamp of claim 1, wherein the colored light sources are light sources selected from the group consisting of LEDs, a halogen lamps and color filters, and gas discharge lamps and color filters.

4. The operating lamp of claim 1, further comprising lenses between the light sources and the operating area, wherein the lenses are adapted to provide uniform emission of light from the lamp and focus the light onto the operating area.

5. The operating lamp of claim 1, wherein the controller is configured to store suitable control parameters as characteristic parameters.

6. The operating lamp of claim 1 wherein the controller is configured to preset a basic setting of the color temperature to 4500 K so that this color temperature is automatically generated when the operating lamp is switched on.

7. An operating lamp comprising:

a means for illuminating an operating area with white light;

means for illuminating the operating area with colored light;

a dimming means for dimming a light intensity from the illumination means at the operating area; and a control means for controlling a spectrum of light from the illumination means at the operating area wherein the dimming means is configured to dim the intensity of the light by controlling an amount of electrical power that powers the illumination means and wherein the dimming means and the control means are configured to, in a first mode, maintain a color temperature of the light on the operating area while dimming the intensity of the light when dimming the intensity via controlling the amount of electrical power and to, in a second mode, maintain an intensity of the light on the operating area while changing the color temperature of the light on the operating area.

8. The operating lamp of claim 7, further comprising lenses between the illumination means and the operating area, wherein the lenses are adapted to provide uniform emission of light from the lamp and focus the light onto the operating area.

9. A method of controlling an operating lamp for illuminating an operating area, the method comprising:

providing light from a white light source of the lamp to the operating area;

providing light from a plurality of colored light sources of the lamp to the operating area;

controlling an intensity of light at the operating area provided from the white light source and the colored light sources by controlling an amount of electrical power that powers the light sources;

controlling a spectrum of the light at the operating area provided from a combination of the white light source and the colored light sources;

in a first operating mode, maintaining a color temperature of the light at the operating area while changing the intensity of the light by controlling an amount of electrical power that powers the light sources;

switching to a second operating mode; and, in the second operating mode, maintaining the intensity of the light at the operating are while changing the color temperature of the light.

10. The method of claim 9, further comprising focusing light from each of the light sources with a lens, wherein the lenses are adapted to provide uniform emission of light from the lamp and focus the light onto the operating area.

11. An operating lamp comprising:

at least one white light source for illuminating an operating area;

a plurality of colored light sources for illuminating the operating area; and a controller for dimming a light intensity and controlling a spectrum of a combined illumination from the white light source and the colored light sources on the operating area, wherein the controller is configured to enable an operator to control the white and colored light sources in two independent modes, including a first mode in which the controller changes an overall intensity of light produced by the operating lamp while maintaining an overall color reproduction of the produced light, and a second mode in which the controller maintains a constant overall intensity of light produced by the operating lamp while changing an overall color reproduction of the produced light.

12. The operating lamp of claim 11, wherein the white light source is a light source selected from the group consisting of an LED, a halogen lamp, and a gas discharge lamp.

13. The operating lamp of claim 11, wherein the colored light sources are light sources selected from the group consisting of LEDs, a halogen lamps and color filters, and gas discharge lamps and color filters.

14. The operating lamp of claim 11, further comprising lenses between the light sources and the operating area, wherein the lenses are adapted to provide uniform emission of light from the lamp and focus the light onto the operating area.

15. The operating lamp of claim 11, wherein the controller is configured to store suitable control parameters as characteristic parameters.

16. The operating lamp of claim 11, wherein the controller is configured to preset a basic setting of the color temperature to 4500 K so that this color temperature is automatically generated when the operating lamp is switched on.

17. An operating lamp comprising:

a means for illuminating an operating area with white light;

means for illuminating the operating area with colored light;

a dimming means for dimming a light intensity from the illumination means at the operating area; and a control means for controlling a spectrum of light from the illumination means at the operating area wherein the dimming means is configured to dim the intensity of the light by controlling an amount of electrical power that powers the illumination means and wherein the dimming means and the control means are configured, in a first mode, to maintain a color reproduction of the light on the operating area while dimming the intensity of the light when dimming the intensity via controlling the amount of electrical power and, in a second mode, to maintain an intensity of the light on the operating area while changing the color reproduction of the light on the operating area.

18. The operating lamp of claim 17, further comprising lenses between the illumination means and the operating area, wherein the lenses are adapted to provide uniform emission of light from the lamp and focus the light onto the operating area.

19. A method of controlling an operating lamp for illuminating an operating area, the method comprising:

providing light from a white light source of the lamp to the operating area;

providing light from a plurality of colored light sources of the lamp to the operating area;

controlling an intensity of light at the operating area provided from the white light source and the colored light sources by controlling an amount of electrical power that powers the light sources;

controlling a spectrum of the light at the operating area provided from a combination of the white light source and the colored light sources;

in a first operating mode, maintaining a color reproduction of the light at the operating area while changing the intensity of the light by controlling an amount of electrical power that powers the light sources;

switching to a second operating mode; and, in the second operating mode, maintaining the intensity of the light at the operating are while changing the color reproduction of the light.

20. The method of claim 19, further comprising focusing light from each of the light sources with a lens, wherein the lenses are adapted to provide uniform emission of light from the lamp and focus the light onto the operating area.

* * * * *

UNITED STATES PATENT AND TRADEMARK OFFICE

CERTIFICATE OF CORRECTION

PATENT NO. : 7,614,763 B2
APPLICATION NO. : 11/067580
DATED : November 10, 2009
INVENTOR(S) : Berthold Leibinger et al.

It is certified that error appears in the above-identified patent and that said Letters Patent is hereby corrected as shown below:

Col. 7 line 33
In Claim 9, delete "operating are" and insert --operating area--.

Col. 8 line 58
In Claim 19, delete "operating are" and insert --operating area--.

Signed and Sealed this

Twenty-sixth Day of January, 2010

David J. Kappos

David J. Kappos
*Director of the United States Patent and Trademark Office*